United States Patent [19]

Cohen et al.

[11] Patent Number: 4,596,053

[45] Date of Patent: Jun. 24, 1986

[54] STATIC CONTROL GARMENT

[75] Inventors: Lenard Cohen, Southboro; Michael E. Gordon, Wayland, both of Mass.

[73] Assignee: Plastic Systems, Inc., Marlboro, Mass.

[21] Appl. No.: 771,308

[22] Filed: Aug. 30, 1985

[51] Int. Cl.[4] ..... A41D 13/04

[52] U.S. Cl. ..... 2/1; 2/51; 361/212; 361/223

[58] Field of Search ..... 2/1, 2, 51; 361/212, 361/223, 224

[56] References Cited

U.S. PATENT DOCUMENTS

| | | | |
|---|---|---|---|
| 1,940,491 | 12/1933 | Freltag | 361/223 X |
| 3,011,172 | 12/1961 | Tames | 2/51 |
| 3,349,285 | 10/1967 | Belkin | 361/223 X |
| 3,381,174 | 4/1968 | Ceraldi | 361/223 |
| 3,596,134 | 7/1971 | Burke | 361/223 X |
| 4,321,925 | 3/1982 | Hoborn et al. | 361/224 X |

*Primary Examiner*—Louis K. Rimrodt

[57] ABSTRACT

A static control garment having torso and limb covering portions with first electrically conductive means in the garment positioned at a limb covering portion adapted to attach to a conductive strap, that encircles a limb of the body, second electrically conductive means in the garment positioned at a torso covering portion adapted to attach to electrical grounding means, and third electrically conductive means interconnecting the first and second electrically conductive means.

8 Claims, 4 Drawing Figures

STATIC CONTROL GARMENT

BACKGROUND OF THE INVENTION

This invention relates to static control garments.

Workers in static-sensitive environments, e.g., electronic assembly plants, often are required to wear both electrically conductive garments, e.g, electrically conductive smocks, and electrical grounding devices, e.g., electrically conductive wrist bands with attached grounding cords, in order to drain static charges that are generated by the workers themselves or that are imparted to them by external sources. Such smocks typically have static-conductive material woven into their fabric to help drain away electrical charges that tend to be generated by rubbing of the material against other clothing, the body, and work surfaces.

Wrist bands typically are made of a conductive fabric with tightening means, e.g, a buckle, to hold them snugly around the wrist. One end of a coiled grounding cord attaches to the wrist band by means of mating metal snaps; and the other end attaches to a central grounding point by means of, e.g., a banana plug.

Although workers generally accept the need to wear smocks, they frequently resist the use of wrist bands with grounding cords because they restrict mobility and make workers feel "tethered". This problem is exacerbated by the effort required—small, but repeated many times in the course of a day—to overcome the mechanical resistance built into the coiled grounding cord. In addition, the grounding cord frequently interferes with the work being done, and sweeps small parts off the work surface.

An object of the present invention is to provide a smock and wrist band grounding system that is comfortable to wear and does not interfere with the work to be done.

SUMMARY OF THE INVENTION

In general the invention features a static control garment having torso and limb covering portions. A first fastener means is positioned at a limb covering portion of the garment, and is adapted to attach to a conductive band that encircles the limb, e.g., the wrist. A second fastener means is positioned at a torso covering portion, e.g., the waist of the garment, and is adapted to attach to electrical grounding means. Electrically conductive means interconnect the first and second fastener means.

In preferred embodiments, the first fastener means is positioned at an end of an electrically conductive tab, the other end of which is positioned at the distal end of a limb covering portion of the garment, and is in electrical contact with the electrically conductive means.

Other features and advantages of the invention will be apparent from the following description of the preferred embodiments and from the claims.

DESCRIPTION OF THE PREFERRED EMBODIMENT

We first briefly describe the drawings.

DRAWINGS

STRUCTURE

Figure 1:
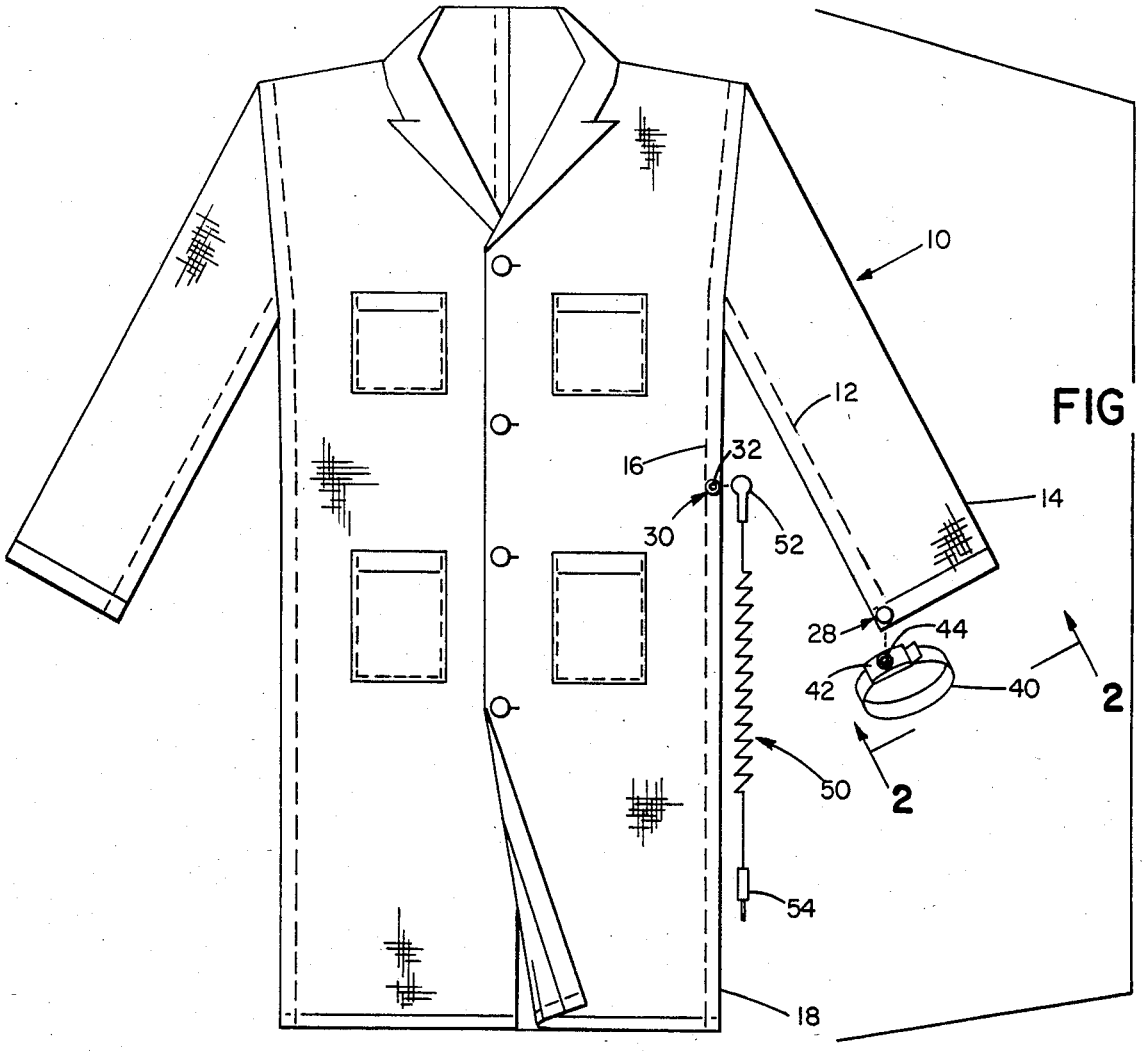
FIG. 1 is an expanded view of the front of a static control smock, a wrist strap and a grounding cord.
Figure 2:
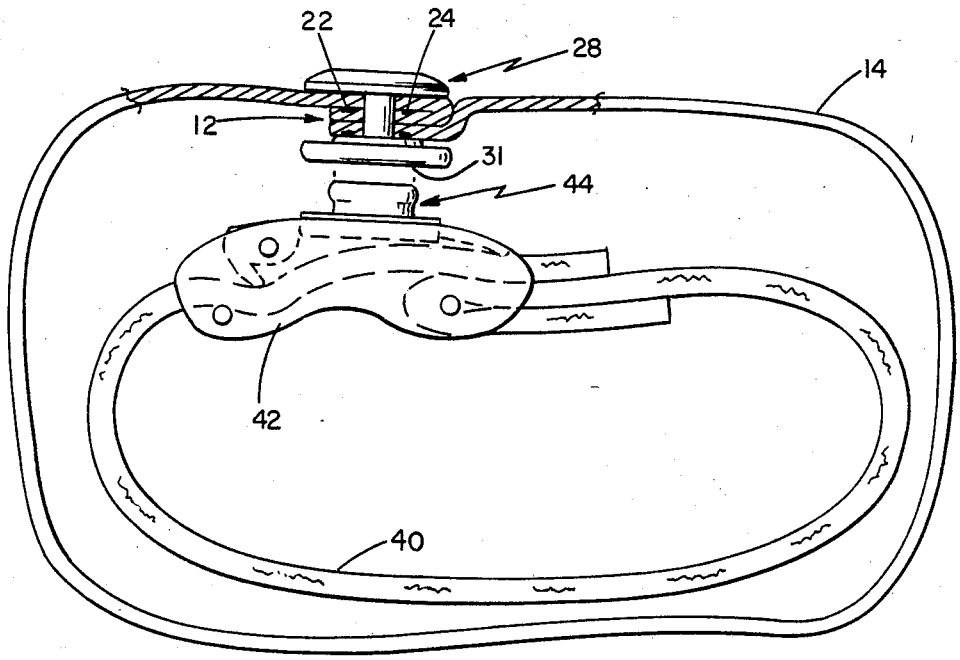
FIG. 2 is an enlarged fragmentary end view of a sleeve, partly in section, with a wrist strap, taken along line 2—2 of FIG. 1.
Figure 3:
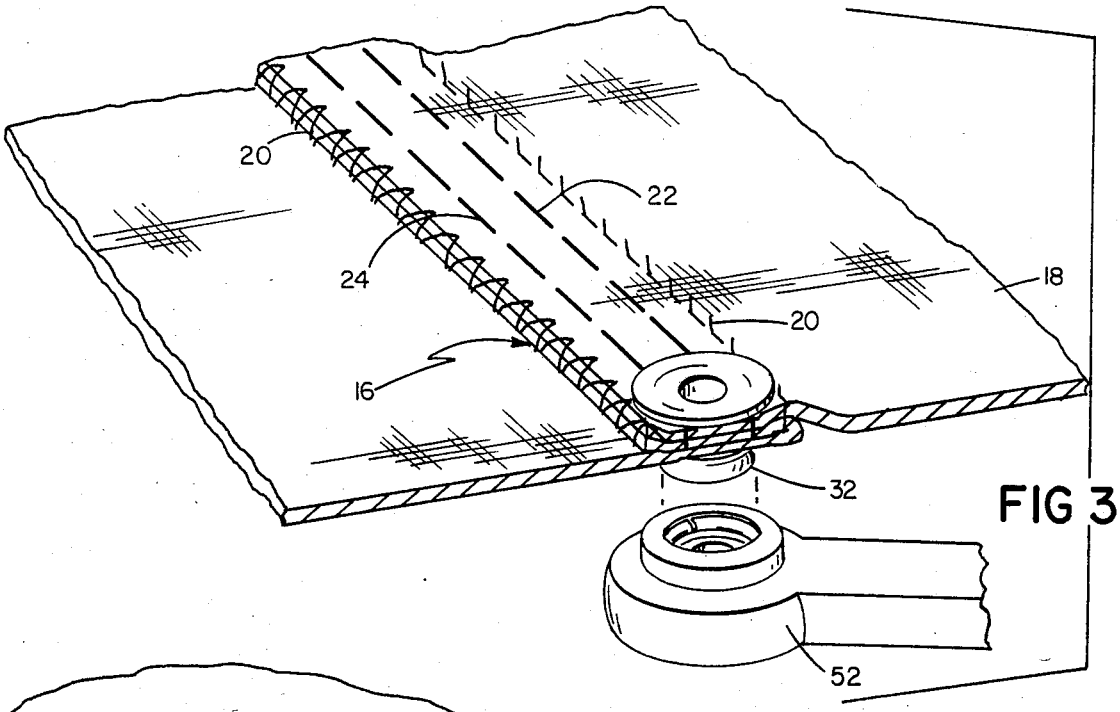
FIG. 3 is an enlarged fragmentary isometric view of the eyelet end of a grounding cord, and of a section of a seam at the waist of a static control smock.

Referring to the drawings, particularly FIGS. 1 and 2, static control smock 10 has sleeve seam 12 in sleeve 14 and side seam 16 in side 18. Sleeve seam 12 and side seam 16 are conventional straight seams sewn with cotton thread 20 in a five-needle overlock with a safety stitch. As shown in FIGS. 2 and 3, inside the garment portions of fabric at seams 12, 16 overlie each other.

Two continuous electrically conductive threads 22, 24 (for example, carbon thread F906 manufactured by Badische Corporation, Williamsburg, Va.) are sewn side by side into and along the length of the overlying fabric within the garment along sleeve seam 12 and side seam 16, between a conductive metal snap socket 28 and a conductive metal snap stud 44, using a conventional double-needle machine lock stitch. The conductive threads 22, 24 are located completely within the garment. As shown in FIG. 2 metal snap socket 28 (for example, X6-10224 socket manufactured by TRW Inc., United Carr Supply Division) is inserted through sleeve seam 12 at the end of sleeve 14 in electrical contact with electrically conductive threads 22, 24, with socket opening 31 on the inside of sleeve 14. As shown in FIG. 3 metal snap stud 32 (for example, BS12303 stud manufactured by TRW Inc., United Carr Supply Division) is inserted through side seam 16 at the waist in electrical contact with electrically conductive threads 22, 24, with stud tip 32 on the outside of smock 10.

Referring to FIG. 2, conductive wrist band 40 (for example, No. WB-4005-RE, manufactured by Plastic Systems, Inc., Marlboro, Mass.) has adjustable closure clamp 42 with attached metal snap button 44 (for example, X2-12126 manufactured by TRW Inc., United Carr Supply Division), which snaps into socket 31.

Referring to FIG. 1, coiled grounding cord 50 (for example, No. WC-4009-RC, manufactured by Plastic Systems, Inc., Marlboro, Mass.) has metal snap eyelet 52 (for example, B512404 manufactured by TRW Inc., United Carr Supply Division) at one end for connection with mating stud 32, and banana plug 54 for insertion into a conventional grounding receptacle (not shown).

OPERATION

In operation, a worker wearing smock 10 fits wrist band 40 to his wrist and snaps the band button 44 into socket 31. Stud 32 at the garment waist is snapped into grounding cord eyelet 52 and banana plug 54 is inserted into a conventional grounding receptacle (not shown).

Static charges on the body are discharged to ground via wrist band 40, along conductive threads 22, 24 to grounding cord 50.

Workers protected by static control smock 10 thus avoid the build-up on their persons of static charges that otherwise might cause damage to sensitive parts and materials in case of electrostatic discharge events. Most important, the grounding connection at the waist permits both hands to be free of the encumbrance of grounding cords, which are uncomfortable and awkward, and which often interfere with the work and sweep small parts off work surfaces.

OTHER EMBODIMENTS

Figure 4:
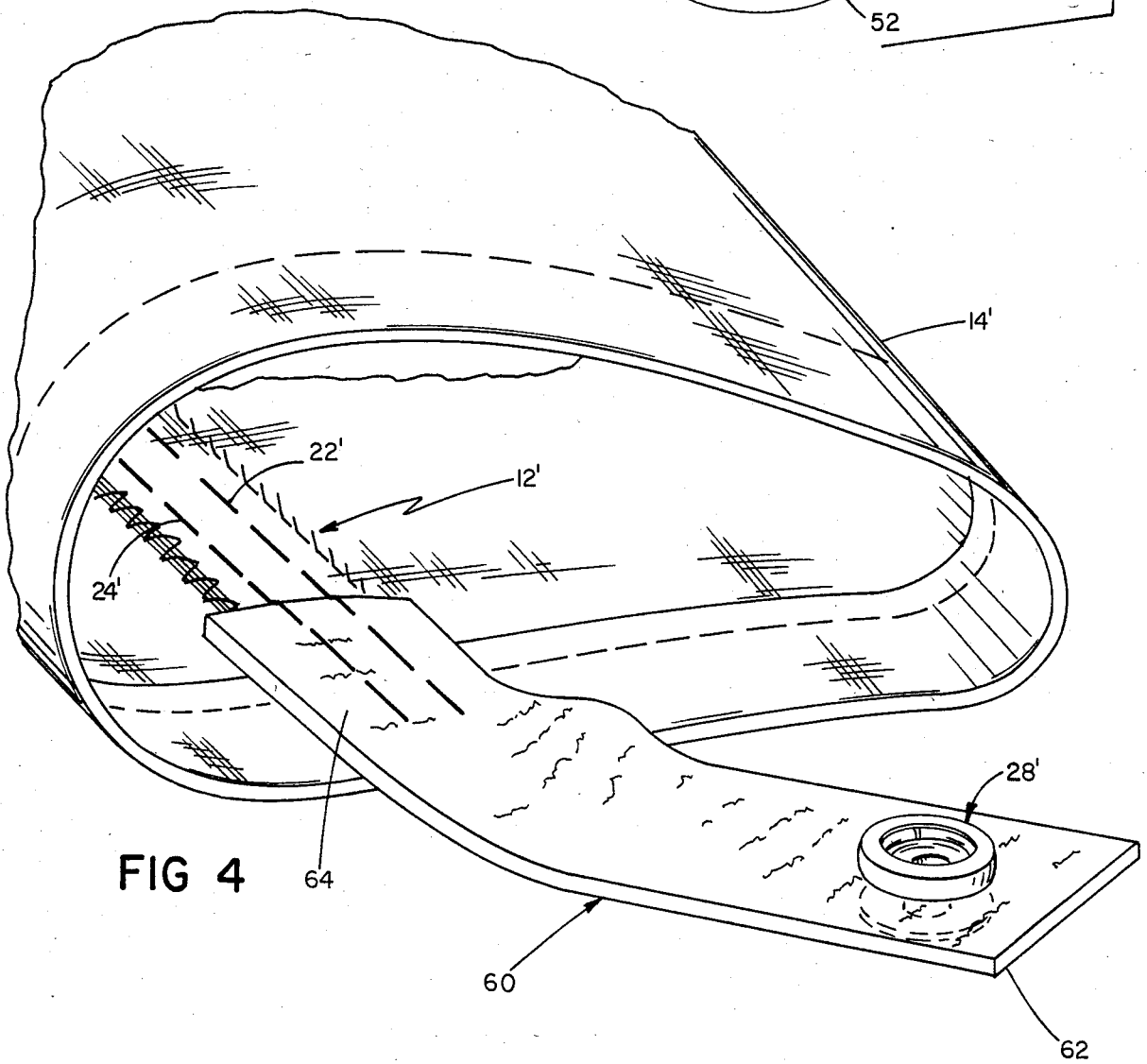
FIG. 4 is a fragmentary isometric view partly in section of the end of a modified sleeve of a static control smock with a conductive tab.

An alternate embodiment, illustrated in FIG. 4, differs from the embodiment previously described in that a conductive cloth tab 60 (e.g., a piece of nylon fabric coated with a conductive elastomer such as neoprene filled with approximately 38% by weight of carbon black) is stitched at one end 58 into electrical contact with both conductive threads 22', 24' at the cuff of sleeve 14', so as to extend beyond the cuff. Metal snap socket 28' is inserted into the other end 62 of tab 60, and mates with the snap button of a wrist band (not shown). In another embodiment (not illustrated), a conductive cloth tab has metal snaps at both ends, one for attachment to a wrist band, the other for attachment to a mating snap in a cuff of the smock.

These embodiments further enhance worker comfort by providing additional slack in the connection between smock 10 and wrist band 40, particularly useful when workers extend the arm while reaching for parts and tools.

Yet other embodiments of this invention will occur to those skilled in the art, and are within the scope of the following claims.

We claim:

1. A static control garment having torso and limb covering portions, comprising:

first electrically conductive means in said garment positioned at a limb covering portion thereof adapted to attach to a conductive strap that encircles a limb of the body, second electrically conductive means in said garment positioned at a torso covering portion thereof adapted to attach to electrical grounding means, and third electrically conductive means interconnecting said first and second electrically conductive means.

2. The static control garment claimed in claim 1 further characterized in that said first conductive means comprises a metal snap.

3. The static control garment claimed in claim 1 further characterized in that said second fastener means comprises a metal snap.

4. The static control garment claimed in claim 1 further characterized in that said first conductive means is positioned at the cuff of a sleeve of said garment, and said second conductive means is positioned at the waist of said garment.

5. The static control garment claimed in claim 1 further characterized in that said third conductive means comprises electrically conductive thread.

6. The static control garment claimed in claim 1 further characterized in that said first conductive means is positioned at an end of a conductive tab, the other end of which is electrically connected within the cuff of a sleeve of said garment to said third conductive means.

7. The static control garment claimed in claim 1 further characterized in that said third conductive means is positioned completely on the interior of the garment and said second conductive means extends through said garment in contact with said third conductive means on the interior of said garment and is adapted for attachment to said grounding means on tne exterior of said garment.

8. A static control garment having torso and limb covering portions, comprising:

a first electrically conductive metal snap in said garment positioned at the cuff of a sleeve of said garment, adapted to attach to a conductive strap that encircles the wrist, a second electrically conductive metal snap in said garment positioned at the waist of said garment, adapted to attach to electrical grounding means, and electrically conductive thread interconnecting said first and second electrically conductive metal snaps.

* * * * *